US006555973B2

(12) United States Patent
Kuisma

(10) Patent No.: US 6,555,973 B2
(45) Date of Patent: Apr. 29, 2003

(54) ARRANGEMENT IN CONNECTION WITH DISCHARGE LAMP

(75) Inventor: Jouko Kuisma, Lahti (FI)

(73) Assignee: Teknoware Oy, Lahti (FI)

( * ) Notice: Subject to any disclaimer, the term of this patent is extended or adjusted under 35 U.S.C. 154(b) by 0 days.

(21) Appl. No.: 09/992,465

(22) Filed: Nov. 16, 2001

(65) Prior Publication Data

US 2002/0101186 A1 Aug. 1, 2002

(30) Foreign Application Priority Data

Nov. 16, 2000 (FI) ..... 20002518

(51) Int. Cl.[7] ..... H05B 37/02

(52) U.S. Cl. ..... 315/291; 315/209 R; 315/219; 315/224; 315/307

(58) Field of Search ..... 315/DIG. 4, DIG. 5, 315/209 R, 219, 224, 225, 291, 307, 308

(56) References Cited

U.S. PATENT DOCUMENTS 4,234,822 A 11/1980 Garrison et al.
4,663,570 A * 5/1987 Luchaco et al. ..... 315/219
4,958,108 A * 9/1990 Jorgensen ..... 315/307
5,107,184 A * 4/1992 Hu et al. ..... 315/291
5,192,896 A * 3/1993 Qin ..... 315/224
5,317,237 A * 5/1994 Allison et al. ..... 315/307
5,519,289 A 5/1996 Katyl et al.
5,559,395 A * 9/1996 Venkitasubrahmanian et al. ..... 315/247
6,100,644 A * 8/2000 Titus ..... 315/209 R

FOREIGN PATENT DOCUMENTS

JP 2000 012262 A 1/2000

* cited by examiner

*Primary Examiner*—Tho Phan
(74) *Attorney, Agent, or Firm*—Leydig, Voit & Mayer, Ltd.

(57) ABSTRACT

An arrangement in connection with a discharge lamp, the arrangement comprising an electronic ballast for igniting and burning the discharge lamp, and a voltage control device arranged to modify supply voltage of the ballast. The voltage control device is further arranged to include a power control signal in the supply voltage. The arrangement further comprises a power filter and a control filter for separating the power control signal from the supply voltage, the ballast being responsive to the power control signal in order to control the level of light of a fluorescent tube.

16 Claims, 2 Drawing Sheets

ARRANGEMENT IN CONNECTION WITH DISCHARGE LAMP

BACKGROUND OF THE INVENTION

The present invention relates to an arrangement in connection with a discharge lamp, the arrangement comprising an electronic ballast for igniting and burning the discharge lamp, and a voltage control device arranged to modify supply voltage of the ballast and to include a power control signal in the supply voltage.

The brightness of incandescent lamps can be controlled, i.e. dimmed, simply by adjusting the working voltage supplied thereto. In alternating current arrangements, the effective value of the voltage is controlled using a method called clipping control. In the clipping control, a thyristor or another semiconductor component is made conductive only for part of the duration of a half cycle of the voltage. In practice, then, part of a sine wave of the mains voltage is cut off. The adjustment is thus carried out by controlling the ignition angle of the semiconductor component in the half cycle.

Direct current arrangements employ pulsed, i.e. pulse-width-modulated (PWM), direct current in order to keep the efficiency of the control device good. A mean value of the pulsed direct current is then formed according to a pulse ratio, i.e. a 50% pulse ratio corresponds to about a 50% voltage value. When pulse frequency is sufficiently high (e.g. 50 Hz), the human eye perceives light as unflickering. This is due to the slowness of the eye and to the thermal mass of an incandescent filament, which makes the temperature of the incandescent filament slow to change. In control arrangements for incandescent lamps, the control may be located separately from the incandescent lamp; most typically, it is installed in connection with a light switch.

In a fluorescent light arrangement or in other discharge lamps, controlling is far more complex since a fluorescent tube necessitates separate power feeds for the tube voltage and the filament voltages when a modern electronic ballast is used. Therefore, the fluorescent tube requires a separate ballast located in connection with the fluorescent tube. The ballast provides the cathodes, i.e. the filaments, of the fluorescent tube with a voltage of their own and the tube with a voltage of its own. When light is adjusted, the tube voltage or tube current and the filament voltage are controlled separately from each other. For operational reasons, the control cannot be located in connection with a lamp since lamps are often located in places that are difficult to reach, such as a ceiling. Thus, the control has to be located in a place from which lights are usually controlled. In such a case, in addition to current feed wires, the controlling also necessitates a separate control wire or a twin wire to the ballast. The need for several wires is impractical and it makes a control solution difficult to install as a replacement for a lamp operating on a normal principle.

Adjustable lighting implemented using fluorescent tubes would be ideal for several different places as far as both energy economy and user-friendliness are concerned. The color-rendering properties of the light produced by the fluorescent tubes are unparalleled over lighting implemented using common incandescent lamps. Typically, fluorescent tubes can be used for adjustable lighting e.g. in auditoria, assembly rooms, theatres and public transportation vehicles. Furthermore, adjustable lighting can be used for making residential buildings much more comfortable, practical and adjustable.

U.S. Pat. No. 5,107,184 presents a system for dimming a fluorescent lamp. In this publication, dimming information is coded within the supply voltage waveform by using power flow interruption coding. In this coding, the information is coded by interrupting the current flow to the ballast in a predetermined sequence. The system of the publication can only be used in connection with AC power.

BRIEF DESCRIPTION OF THE INVENTION

An object of the present invention is to provide an arrangement which avoids the above-mentioned drawbacks and which enables the level of light of a fluorescent tube to be controlled using a simple apparatus without separate wires for the controlling. This object is achieved by an arrangement of the invention, which is characterized in that the voltage control device is arranged to modify the base-frequency pulse shape of the supply voltage of the ballast to include power control information in the supply voltage, and that the arrangement further comprises a power filter and a control filter for separating the power control signal from the supply voltage, the ballast being responsive to the power control signal in order to control the level of light of a fluorescent tube.

The arrangement of the invention is based on the idea that a voltage control device, such as a control implementing clipping control, is used for modifying the supply voltage in a manner similar to that in connection with an incandescent lamp. From the pulsed voltage, a power control signal is then separated using a separate control filter, and on the basis of the signal, a ballast is used for conveying the desired current to the fluorescent tube in order to burn the fluorescent tube at a desired level of brightness. The arrangement enables the fluorescent tube to be controlled without an additional control wire or twin wire, allowing a simple control previously possible only in connection with incandescent lamps to be used for adjusting the brightness.

BRIEF DESCRIPTION OF THE DRAWINGS

The invention is now described in closer detail in connection with preferred embodiments and with reference to the accompanying drawings, in which.

DETAILED DESCRIPTION OF THE INVENTION

Figure 1:
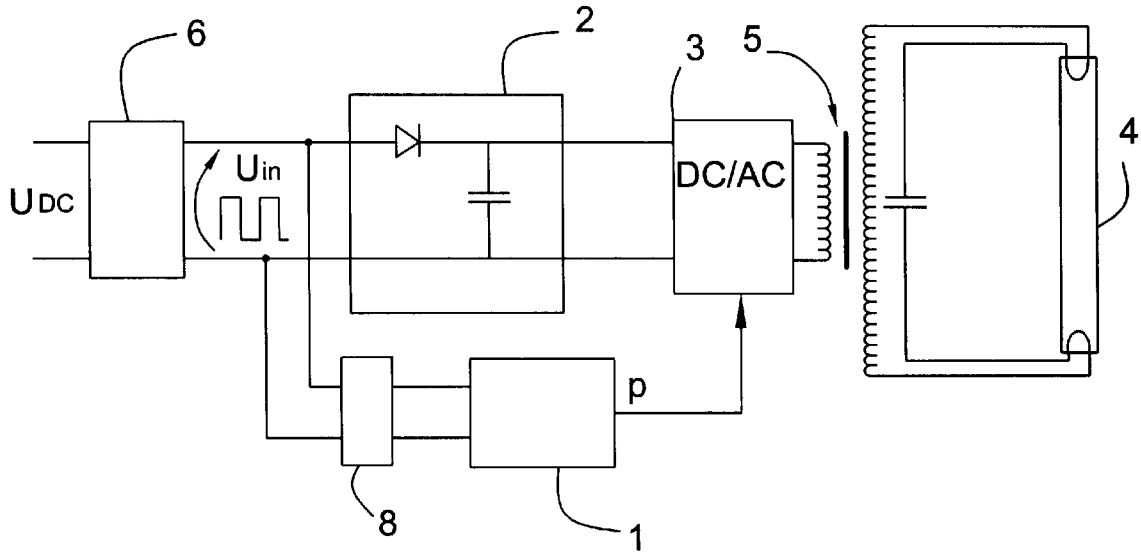
FIG. 1 shows an arrangement of the invention in connection with a direct current arrangement.

In the following, the arrangement will be described by way of example in connection with a fluorescent tube, but it is to be understood that the invention can also be applied in connection with other discharge lamps. FIG. 1 shows how an arrangement of the invention is implemented in connection with a direct current arrangement. A lamp is burned using direct current converted into a pulsed supply voltage Uin. According to the invention, the arrangement comprises a voltage control device 6, 7. In connection with the present invention, a voltage control device refers to a device operated e.g. manually, or automatically according to a particular predetermined program. In other words, voltage is controlled in order to achieve a desired level of lighting. In connection with a direct current arrangement, the voltage control device is typically a pulse modulator 6, as shown in FIG. 1.

In FIG. 1, direct current is pulsed using a known modulation method, such as pulse width modulation (PWM). According to the invention, modulation is used for producing a power control signal affecting the intensity of lighting, the signal being included in the electric power to be transmitted to the ballast of the fluorescent tube. The direct current is modulated in connection with an apparatus for controlling the brightness of the lamp.

Pulse width modulation is carried out e.g. by comparing a triangular wave to the direct current to be controlled and by coupling, using a switch component, a voltage to the load when the triangular wave is smaller than the direct current to be controlled, and, in the opposite case, by coupling the voltage off the load. Setting the triangular wave amplitude and the range of variation of the direct current to be controlled as equal in magnitude will result in a full 100% modulation area. The pulse ratio supplied to the load can thus be affected by adjusting the mentioned direct voltage level. Direct-current-operated fluorescent tube arrangements are applied e.g. to the lighting of buses or other low-voltage tasks.

The arrangement of the invention also comprises a control filter 1 for separating a power control signal p from the supply voltage. In the embodiment of FIG. 1, the control filter 1 is e.g. a low-pass filter, which filters a PWM signal into a corresponding direct current level. This voltage level can be scaled appropriately to directly operate as the power control signal. Since the direct voltage amplitude may vary, and thus have an undesired effect on the direct voltage level being formed, it is thus preferable to couple a clipper circuit 8 of the amplitude before the control filter 1. The amplitude of a pulse sequence conveyed to the control filter is thus even, and the low-pass-filtered voltage level being thus generated accurately corresponds to a target level encoded as pulses in the supply voltage. This results in a particularly accurate adjustment.

Figure 3:
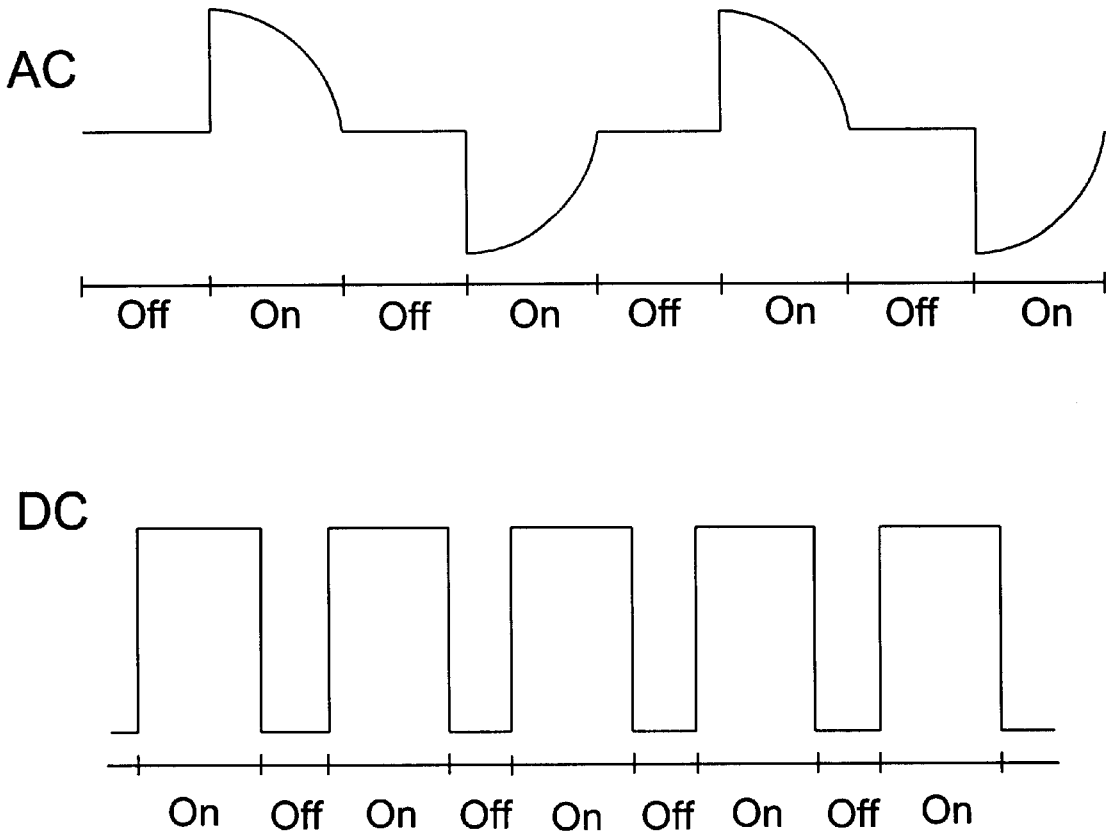
FIG. 3 shows basic supply voltage waveforms of direct current and alternating current arrangements.

A second embodiment for separating a power control signal in the control filter is to digitally count on/off times of the pulses and to generate an actual control signal on the basis of these time periods. However, this is far more expensive to implement than the analogue method described above. FIG. 3 shows the basic supply voltage waveforms of direct current (DC) and alternating current (AC) arrangements. The DC waveform is a PWM signal in which the on and off times are indicated.

The embodiment of FIG. 1 shows how the control signal p is separated from the PWM signal, using the control filter 1 while the supply voltage is transmitted to a power filter part 2. At its simplest, the power filter part 2 comprises a coupling of a diode and a capacitor, which constitutes a low-pass filter for the pulse-like voltage to be supplied. The capacitor is charged to a voltage corresponding to the peak value of the pulse voltage, and it operates as an energy storage for the actual power feed part of the ballast. The diode is responsible for operating as a reverse current diode, and thus for preventing the PWM signal from becoming interfered with.

Figure 2:
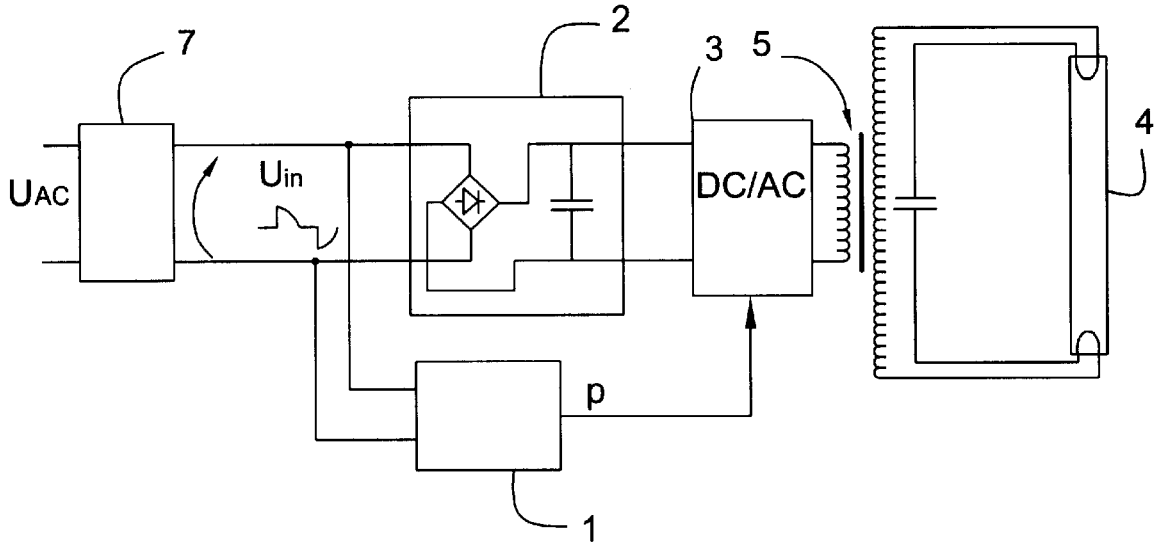
FIG. 2 shows the arrangement of the invention in connection with an alternating current arrangement.

In the embodiment of FIG. 2, the supply voltage Uin is produced using the voltage control device 7 of the invention directly from the sine-like voltage. Most typically, such a sine-like voltage is the mains voltage. The voltage control device employs alternating current, i.e. in the case of FIG. 2, the device is a normal clipping control 7. Clipping controls are generally used for dimming incandescent lamps. Clipping control can be used for removing a portion of a desired magnitude from initial parts of the half-waves of the sine-like voltage, and by changing the ignition angle, the effective value of the supply voltage can be changed. As mentioned above, FIG. 3 shows the waveform of the AC arrangement. The waveform (AC) is a sine-like wave in which portions are removed by clipping control.

In the alternating current arrangement, using a control filter, a control signal is removed from the supply voltage Uin in a similar manner to that used in connection with the direct current arrangement. The times of ignition of the half-waves of the sine-like voltage thus operate as the controlled variable included in the supply voltage. These points of time can be detected from the curve shape e.g. using a combination of a simple comparator circuit and a counter circuit. A comparator is used for finding out the time of ignition of a pulse, and this point of time is compared e.g. to the zero point of the sine voltage. The time of ignition thus unambiguously determines the level of a control signal to be transmitted from the control filter.

The power filter part 2 of the alternating current arrangement shown in FIG. 2 differs from the power filter part of the direct current arrangement in that in connection with the alternating current arrangement, the supply voltage Uin is rectified using e.g. a common diode rectifier bridge. After being rectified, the voltage charges the capacitor to a peak value of the rectified voltage.

In addition to filtering the control signal, the control filter is responsible for transmitting the control signal p to a DC/AC converter 3 of the ballast. This inverter converts the direct voltage charged in the capacitor into alternating voltage, and itself adapts the voltage according to a fluorescent tube 4. Typically, electronic ballasts generate voltage having a frequency ranging between 20 . . . 100 kHz for a lamp, feeding appropriate alternating currents both to the cathodes of the tube and to the tube itself. In FIGS. 1 and 2, current is fed into the lamps in the lamp circuit through an inductive coupling, using a transformer coupling 5.

At its simplest, the control signal p transmitted by the control filter 1 is a voltage level, which may vary e.g. from one to ten volts. This voltage level is then interpreted in the ballast in a manner known per se, and a chopper-type DC/AC converter converts its modulation on account of the signal to generate appropriate voltages to the lamp circuit both for the cathodes and the tube, thus controlling the luminosity obtained from the tube. Such an embodiment reacting to the voltage signal is known per se from solutions wherein a separate control signal is conveyed to the ballast through a separate control wire.

According to a preferred embodiment of the invention, the power filter part comprises a chopper circuit for correcting a power factor. Such a chopper circuit is commonly used for correcting the power factor of devices using alternating voltage, and it can be applied in connection with the embodiments of both FIG. 1 and FIG. 2.

It is to be noted that although in the figures and in the description the arrangement has been disclosed as separate operational blocks, all circuits necessary for the implementation, excluding the voltage control device, are located in connection with the fluorescent tube, coupled to the ballast thereof.

When the operation of a control circuit is implemented such that a low pulse width correspondingly yields a low level of light, energy consumption thus also being low, a sufficiently good filtering can correspondingly be achieved using a smaller filter unit in the power feed unit. Such an arrangement enables dimming control and power feed to be achieved in as high as 5 . . . 100% power range, the pulse width control range being 5 . . . 100%, correspondingly. In practice, this means that when the pulse width decreases, the filtering capacity of a filtering circuit has to be increased in the same proportion. It is thus more reasonable to use a narrower pulse width range, enabling a smaller and more advantageous power filter part. In practice, the above-mentioned arrangement works well in a 50 . . . 100% pulse width range, because when the pulse width is small, energy consumption is small as well. However, the control part and its counter can be tuned to enable the entire control range to be used. In such a case, e.g. a 50% pulse width corresponds to a 5% light level, and, correspondingly, a 100% pulse width corresponds to a 100% light level. Naturally, moving between these extremes can be implemented in a linear manner. Restricting the pulse width to a 50% minimum thus means that the voltage control device generates pulses ranging between 50 . . . 100%.

It is obvious to one skilled in the art that as technology advances, the basic idea of the invention can be implemented in many different ways. The invention and its embodiments are thus not restricted to the examples described above but they may vary within the scope of the claims.

What is claimed is:

1. An arrangement for use with a discharge lamp for emitting a level of light, the arrangement comprising:

an electronic ballast for igniting and burning the discharge lamp, a voltage control device adapted to modify a supply voltage comprising a base-frequency with a pulse shape and to include a power control signal in the supply voltage, wherein the voltage control device is adapted to modify the base-frequency pulse shape of the supply voltage to include power control information, and a power filter and a control filter for separating the power control signal from the supply voltage, the ballast being responsive to the power control signal in order to control the level of light of the discharge lamp.

2. The arrangement of claim 1, wherein the voltage control device is adapted to modify the supply voltage such that the supply voltage is converted into a pulsed voltage having an on/off pulse ratio, and that the control filter is adapted to generate the power control signal from the on/off pulse ratio of the pulsed voltage.

3. The arrangement of claim 2, wherein the voltage control device is located on a line feeding the ballast of the discharge lamp.

4. The arrangement of claim 2, wherein the voltage control device is a clipping control arranged to cut off parts of half-waves of the supply voltage.

5. The arrangement of claim 2, wherein the voltage control device is a pulse modulator adapted to generate a pulsed signal.

6. The arrangement of claim 2, wherein the arrangement further comprises an amplitude clipping circuit arranged to cut an amplitude of a signal supplied to the control filter to a predetermined value.

7. The arrangement of claim 2, wherein the power filter comprises a chopper circuit for correcting a power factor.

8. The arrangement of claim 1, wherein the voltage control device is located on a line feeding the ballast of the discharge lamp.

9. The arrangement of claim 1, wherein the voltage control device is a clipping control adapted to cut off parts of half-waves of the supply voltage.

10. The arrangement of claim 1, wherein the voltage control device is a pulse modulator arranged to generate a pulsed signal.

11. The arrangement of claim 10, wherein the arrangement further comprises an amplitude clipping circuit arranged to cut an amplitude of a signal supplied to the control filter to a predetermined value.

12. The arrangement of claim 10, wherein the power filter comprises a chopper circuit for correcting a power factor.

13. The arrangement of claim 1, wherein the arrangement further comprises an amplitude clipping circuit adapted to cut an amplitude of a signal supplied to the control filter to a predetermined value.

14. An arrangement as claimed in claim 13, wherein the power filter comprises a chopper circuit for correcting a power factor.

15. The arrangement of claim 1, wherein the power filter comprises a chopper circuit for correcting a power factor.

16. The arrangement of claim 1, wherein the discharge lamp comprises a fluorescent tube.

* * * * *